US006246311B1

(12) United States Patent
Finnemore et al.

(10) Patent No.: US 6,246,311 B1
(45) **Date of Patent: *Jun. 12, 2001**

(54) INDUCTIVE DEVICES HAVING CONDUCTIVE AREAS ON THEIR SURFACES

(75) Inventors: Fred M. Finnemore, Jefferson, ME (US); Steven N. Montminy, Groton; Patrizio Vinciarelli, Boston, both of MA (US)

(73) Assignee: VLT Corporation, San Antonio, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/979,518

(22) Filed: Nov. 26, 1997

(51) Int. Cl.[7] ..... H01F 27/08; H01F 27/29

(52) U.S. Cl. ..... 336/192; 336/229; 336/83; 336/65

(58) Field of Search ..... 336/192, 83, 229, 336/65

(56) References Cited

U.S. PATENT DOCUMENTS

| | | | | |
|---|---|---|---|---|
| 3,585,553 | * | 6/1971 | Muckelroy et al. | 336/192 |
| 3,750,069 | * | 7/1973 | Renskers | 336/83 |
| 4,103,267 | * | 7/1978 | Olschewski | 336/229 |
| 4,498,067 | * | 2/1985 | Kumokawa et al. | 336/83 |
| 4,595,901 | * | 6/1986 | Yahagi | 336/192 |
| 4,696,100 | * | 9/1987 | Yamamoto et al. | 336/192 |
| 4,725,806 | * | 2/1988 | Chamberlin | 336/192 |
| 4,769,900 | * | 9/1988 | Morinaga et al. | 336/192 |
| 4,777,461 | * | 10/1988 | Sakamoto | 336/192 |
| 4,777,465 | * | 10/1988 | Meinel | 336/65 |
| 4,842,352 | * | 6/1989 | Sasaki et al. | 336/83 |
| 4,926,151 | * | 5/1990 | Morinaga | 336/83 |
| 4,975,671 | * | 12/1990 | Dirks | 336/65 |
| 5,072,508 | * | 12/1991 | Kaneko et al. | 336/292 |
| 5,349,743 | * | 9/1994 | Grader et al. | 336/200 |
| 5,457,872 | * | 10/1995 | Sakata et al. | 336/192 |
| 5,487,214 | | 1/1996 | Walters . | |
| 5,530,416 | * | 6/1996 | Wakamatsu et al. | 336/192 |
| 5,546,065 | | 8/1996 | Vinciarelli et al. | 336/84 C |
| 5,546,069 | | 8/1996 | Vinciarelli et al. . | |

FOREIGN PATENT DOCUMENTS

| | | | | |
|---|---|---|---|---|
| 0146706 | * | 6/1990 | (JP) | 336/192 |

OTHER PUBLICATIONS

TDK Inductor Nov. 4, 1997.

* cited by examiner

*Primary Examiner*—Anh Mai
(74) *Attorney, Agent, or Firm*—Fish & Richardson P.C.

(57) ABSTRACT

An inductive device includes a magnetic core, a conductive winding surrounding the core, a conductive element formed on a selected portion of the surface of the magnetic core, and a termination of the winding mechanically attached and electrically connected to the conductive element.

In an assembly that includes a circuit board the conductive element is mechanically attached and electrically connected to a connection pad on the board and the winding termination is connected to the conductive element.

48 Claims, 5 Drawing Sheets

INDUCTIVE DEVICES HAVING CONDUCTIVE AREAS ON THEIR SURFACES

BACKGROUND OF THE INVENTION

This invention relates to inductive devices having conductive areas on their surface.

A typical inductive device is formed by winding conductive wire around the body of a magnetic core or around a bobbin supporting a magnetic core. Transformers, for example, have primary and secondary windings surrounding the body of the core. The terminations of the primary and secondary windings are connected to input and output circuits, respectively. When used in an electronic circuit, a transformer performs the function of stepping up or down an input voltage and providing an output with a required voltage, frequency, and phase.

In a typical electronic assembly the winding terminations of inductive devices are inserted into holes in the printed circuit board and soldered. Electronic components in a typical electronic assembly are often mounted on the surface of a printed circuit board by an automated assembly process. To permit surface mounting of an inductive device the core with the windings typically is attached to a structure (e.g. a box or a frame). The winding terminations are attached to features on the exterior of the structure (contacts or leads), which in turn are attached to a printed circuit board. The structure and interposing attachment features occupy additional volume which would otherwise have been available for circuit elements. The shape of the core used for an inductive device also affects the space otherwise available for other circuit components. Typical inductive devices use cylindrical or ring-shaped annular cores. These toroidal structures do not fit well with the other mostly square electronic components on the printed circuit board. Inductive devices with non-toroidal cores exhibit flux leakage and demagnetization due to their geometry. A more rectangular core shape is shown for example in U.S. pat. No. 5,546,065. That patent describes the use of conductive shields on the surface of the magnetic core to control leakage inductance.

SUMMARY OF THE INVENTION

In general, in one aspect, the invention features an inductive device that includes a magnetic core, a first conductive winding surrounding the core, a first conductive element formed on selected portion of a surface of the magnetic core, and a first termination of the winding mechanically attached and electrically connected to the first conductive element.

Implementations of the invention may include one or more of the following features. The device may include a second conductive element electrically isolated from the first and a second termination of the primary winding mechanically attached and electrically connected to the second conductive element. A second conductive winding may also surround the core, and two additional electrically isolated conductive elements may be formed on selected portions of a surface of the magnetic core, to which may be connected the two terminations of the second winding.

In general, in another aspect, the invention features an inductive device assembly that includes a circuit board bearing a first connection pad, a magnetic core, a first conductive winding surrounding the core, and a first conductive element formed on a selected portion of the surface of the magnetic core. The conduction element is mechanically attached to and electrically connected to the connection pad and a first winding termination is mechanically attached and electrically connected to the first conductive element.

Implementations of the invention may include one or more of the following features. The windings may be formed from metallic wire, metallic foil, or metallic film lines deposited on the surface of the magnetic core. The conductive element may include layers of a silver-filled epoxy, copper and tin. The magnetic core may have polygonic outside and/or inside perimeters and flat top and bottom surfaces. The dimensions may be chosen to maintain a generally constant cross-sectional area of the core. The core may be a ferrite or iron powder, and may include an electrical insulation layer. The electrical insulation layer may be a para-xylylene polymer.

In general, in another aspect, the invention features a method of making an inductive device by covering a selected area of a magnetic core surface with a conductive element, winding a conductive winding around the core and attaching a termination of the conductive winding to the conductive element.

In general, in another aspect, the invention features a method of making an inductive device assembly by forming a connection pad on a circuit board, covering a selected area of a magnetic core surface with a conductive element, winding a conductive winding around the core and attaching mechanically and connecting electrically the conductive element to the connection pad on the circuit board. A termination of the winding may also be mechanically attached and electrically connected to the conductive element on the surface of the core.

Implementations of the invention may include one or more of the following features. The winding terminations may be mechanically attached and electrically connected to the conductive areas by soldering or thermal compression bonding. The covering of the selected surface areas of the magnetic core with the conductive element may include gravure printing of a silver epoxy, electroplating of copper and electroplating or immersion plating of tin. The inductive device may be connected to the printed circuit board by soldering the conductive surface areas of the core to the contacts on the board. The inductive device may also be attached and connected to the board connection pads via a conductive adhesive.

Among the advantages of the invention may be one or more of the following. The invention integrates and combines the function of conductive magnetic flux shields, winding terminations and device mounting contacts on the surface of a magnetic core. The device may be mounted on a printed circuit board by attaching the mounting contacts to the board connection pads, a process suitable for automation and compatible with surface mount printed circuit board technology. In another aspect, an inductive device may be provided, which incorporates windings, winding terminations and mounting contacts on the surface of a magnetic core with any desired geometric configuration.

Other features and advantages of the invention will be apparent from the following description of the preferred embodiments, and from the claims.

DESCRIPTION OF THE PREFERRED EMBODIMENTS

Figure 1:
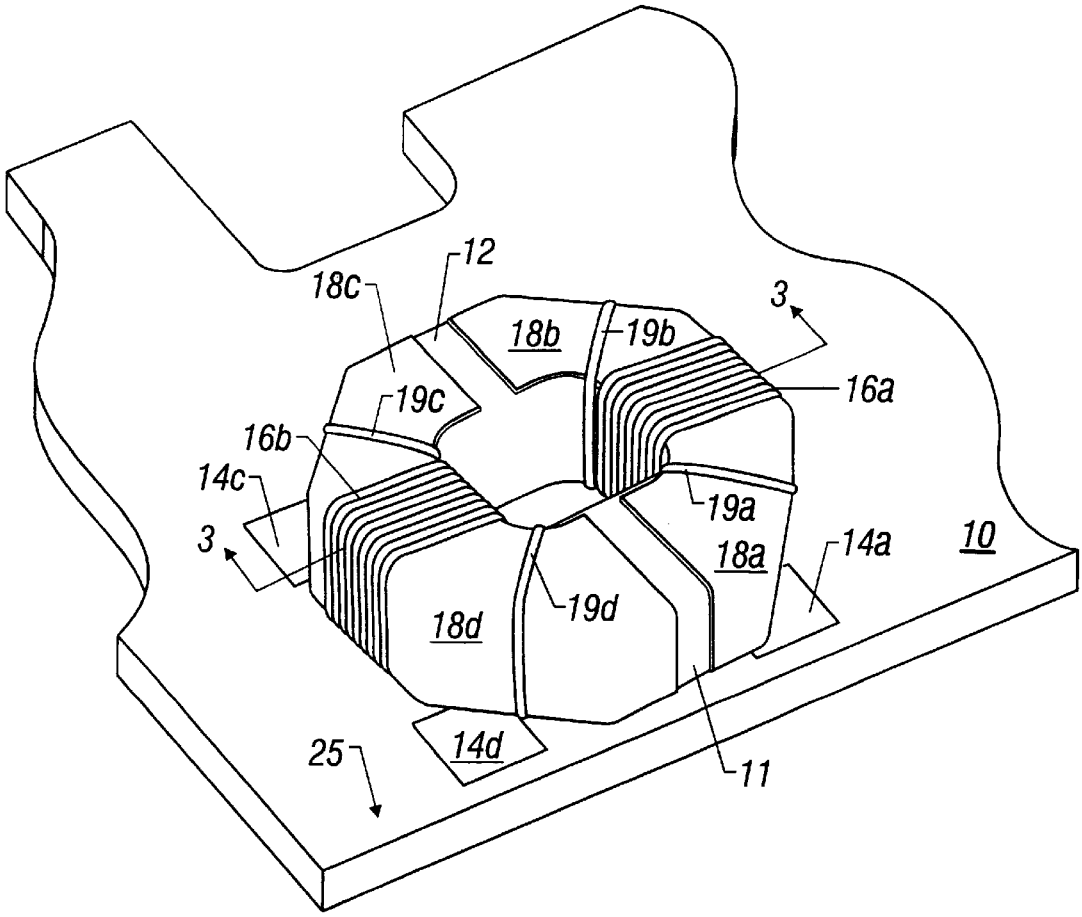
FIGS. 1 and 2 are a perspective view and an exploded perspective view, respectively, of a transformer mounted on a printed circuit board.
Figure 2:
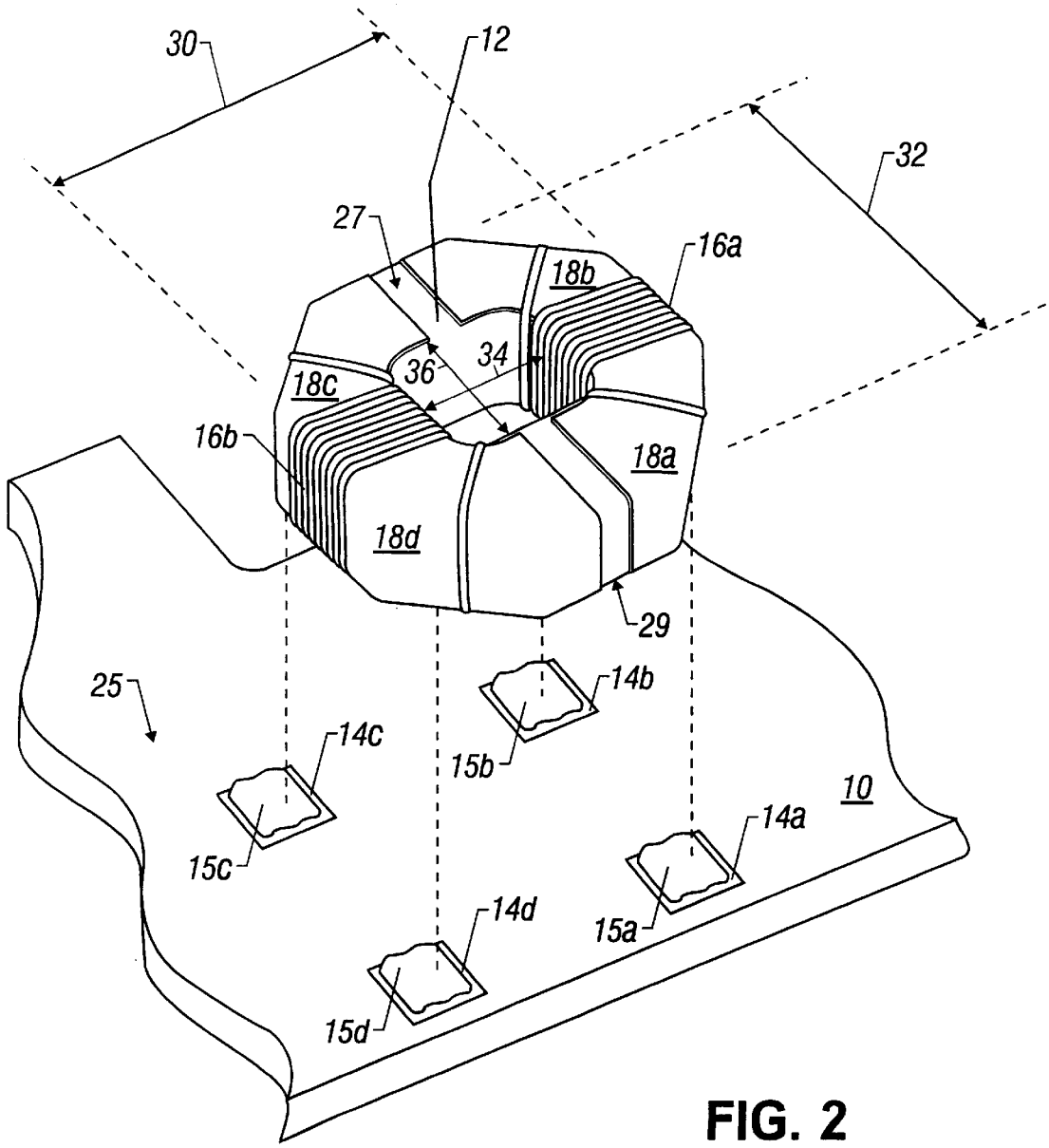
Figure 4:
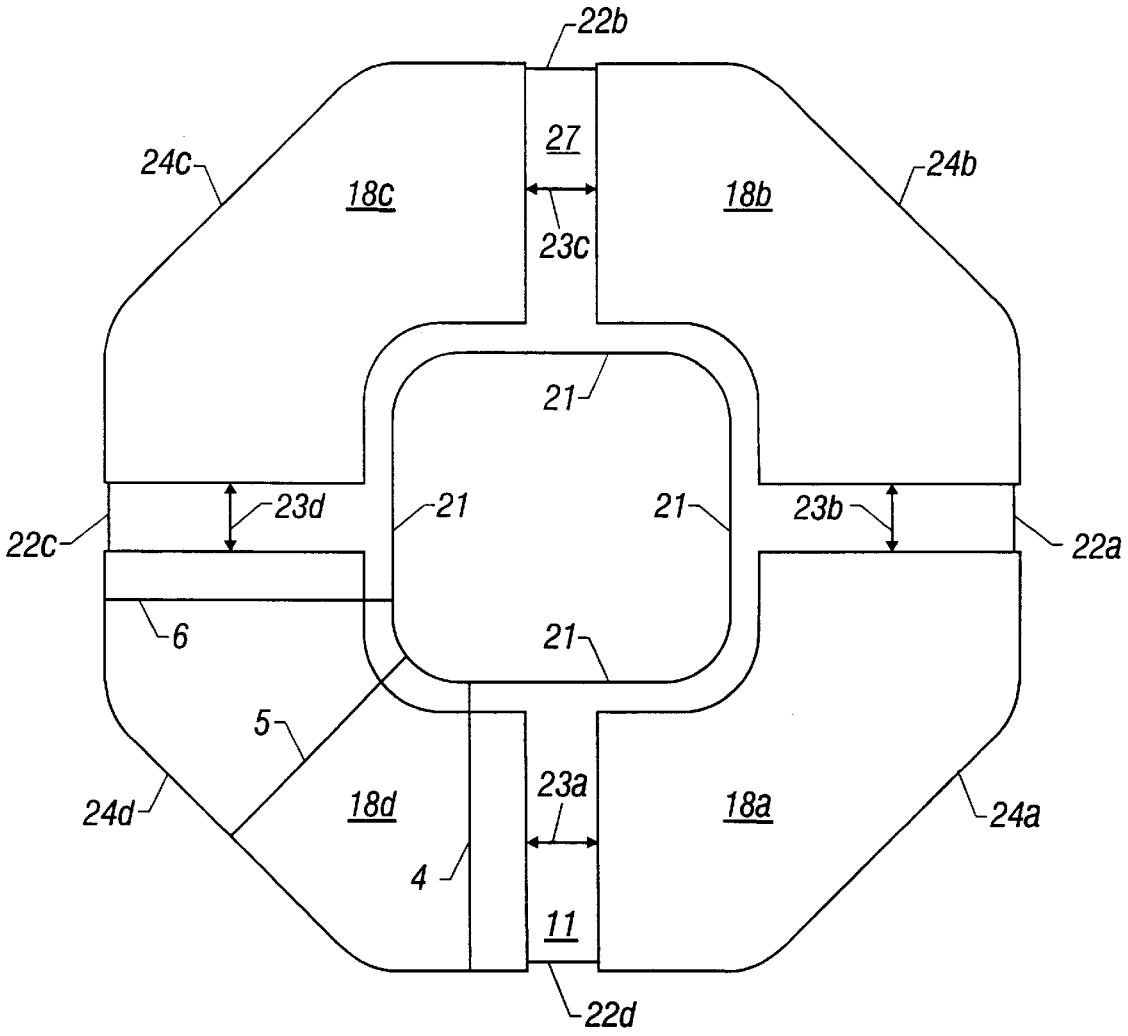
FIG. 4 is a top view of the magnetic core.

Referring to FIG. 1, a transformer 12 is mounted directly on a top surface 25 of a printed circuit board 10, with other electronic components (not shown). The transformer 12 includes a primary winding 16*a*, a secondary winding 16*b*, and metal shields 18*a* through 18*d*, formed on the surface of a one-piece annular ferrite core 11. As seen in FIG. 4, the shape of annular core 11 is defined by a square inner peripheral wall 21; an octagonal outer peripheral wall 22 that has four segments 22*a*, 22*b*, 22*c*, and 22*d* parallel to the four sides of inner wall 21 and four segments 24*a*, 24*b*, 24*c*, and 24*d* that "cut off the corners" of the outer wall; and top and bottom surfaces 27 (FIG. 2) and 29 (FIG. 5), respectively. The shields 18*a* through 18*d*, respectively, cover the top 27 and bottom 29 surfaces and segments 24*a* through 24*d* of the outer wall at the four quadrants of the core, leaving the inner wall 21 and gaps 23*a* through 23*d* uncovered. The geometry and placement of the shields are chosen so that they serve as magnetic flux shields, to reduce demagnetization and flux leakage occurring at the sharp edges and corners of the core.

Figure 5:
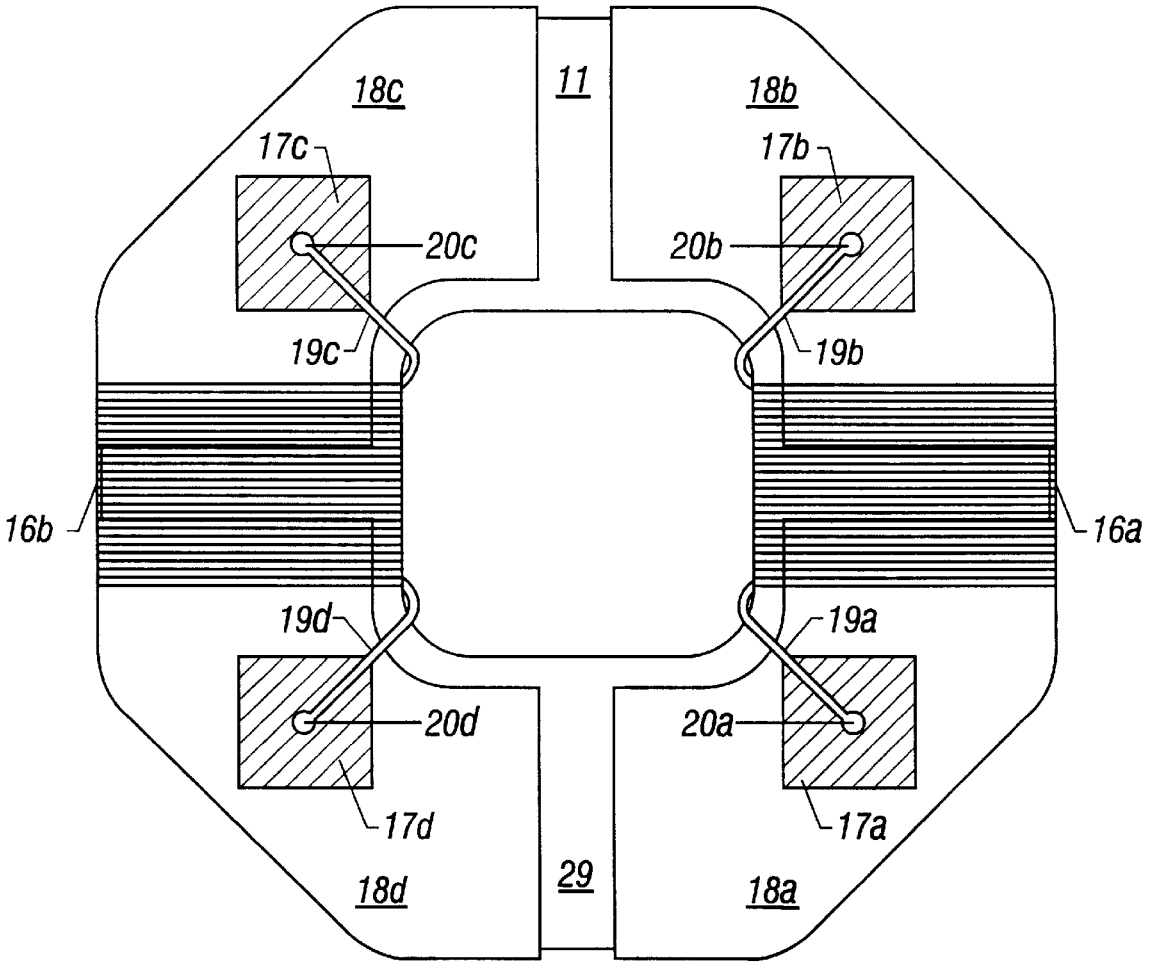
FIG. 5 is a bottom view of the transformer.

The shields also provide attachment points 20*a* through 20*d* (FIG. 5) for winding terminations 19*a* through 19*d*, respectively. The terminations 19*a* and 19*b* of the primary winding 16*a* are soldered to the bottom of the adjacent shields 18*a* and 18*b* at attachment points 20*a* and 20*b*, which are on the bottom surface 29 of core 11 (FIG. 5). Similarly, the terminations 19*c* and 19*d* of the secondary winding 16*b* are soldered to the adjacent shields 18*c* and 18*d* at attachment points 20*c* and 20*d* at the bottom of core 11, respectively. The shields 18*a* through 18*d* also provide connection surfaces 17*a* through 17*d* for mounting the transformer 12 on the surface 25 of the board 10 via solder connections 15*a* through 15*d* (FIG. 2) to board connection pads 14*a* through 14*d*, respectively.

Figure 3:
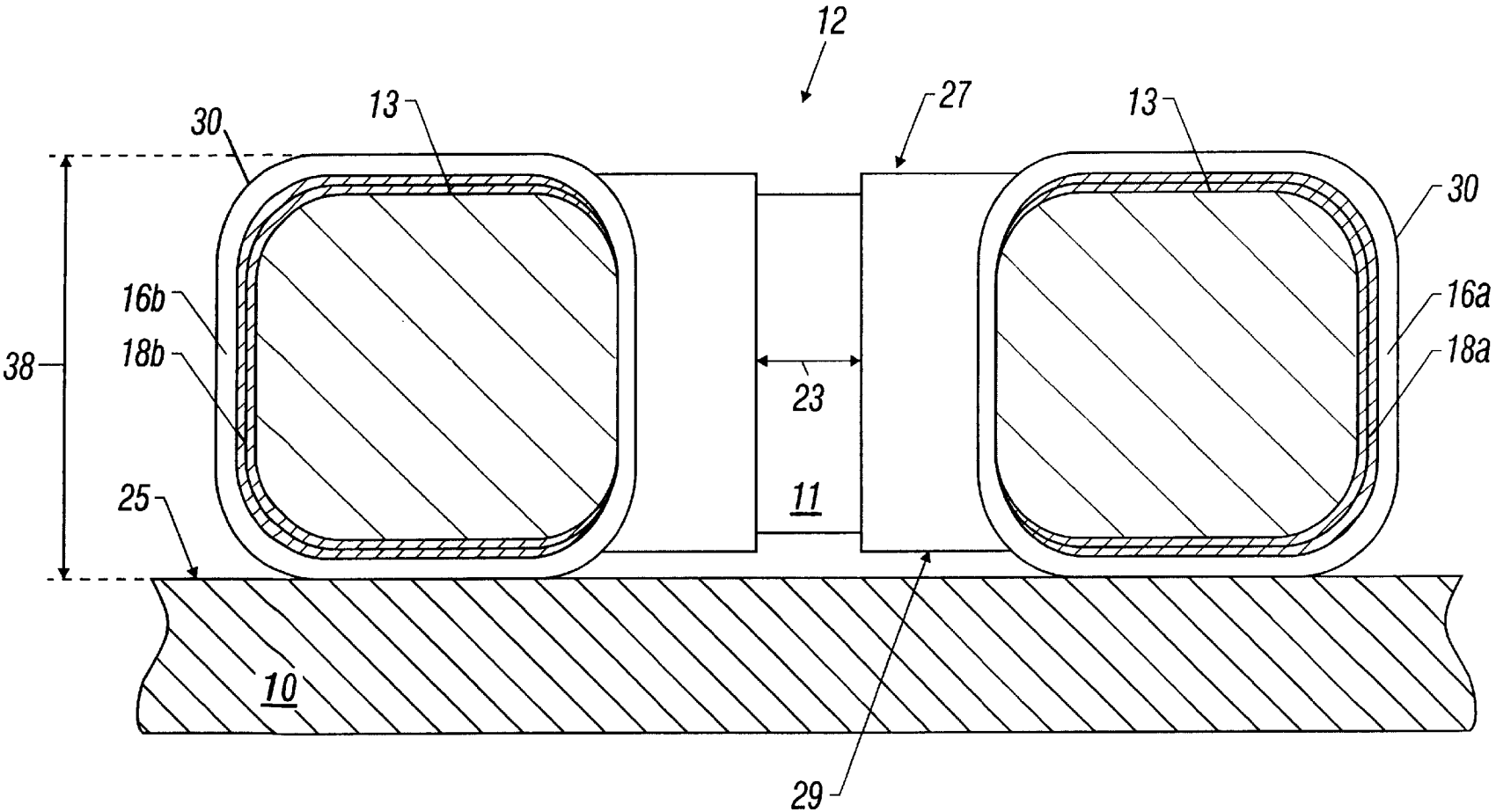
FIG. 3 is a cross-sectional view at 3—3 on FIG. 1.

Referring to FIG. 3, an insulating layer 13 covers the entire surface of the magnetic core 11. The windings 16*a* and 16*b* also have an insulation layer 30 and together with the shields 18*a* through 18*d* lie on the insulating layer 13 of the core. The insulating layer 13 has uniform thickness, covers both the flat surfaces and sharp edges and corners of the core, insulates even at low thicknesses, and can withstand high operating temperatures. The geometry and dimensions of the inner and outer peripheral walls 21, 22 are chosen to maintain a generally constant cross sectional area at all positions around the core 11. Referring to FIG. 4, the cross sectional areas along the lines 4, 5 and 6 are approximately equal to each other. In one example, the transformer has outer dimensions 30, 32 of 0.211"×0.2", inner dimensions 34, 36 of 0.07"×0.07" and a height 38 (FIG. 3) of less than 0.07".

To make the transformer, the core is first coated with para-xylylene polymer by thermal polymerization to a thickness of about 0.5 mils. The shields are then formed. The shields comprise several layers, including silver-filled epoxy, copper, and tin. The silver-filled epoxy is deposited with a thickness in the range of 0.1 to 0.3 mils by gravure pad printing on the insulating layer 13. Copper is electroplated to a thickness of about 2 mils on the silver-filled epoxy. Tin is electroplated on the copper with a thickness in the range of 0.25 to 0.5 mils. The windings 16*a*, 16*b* are then wound on the coated and shielded core 11, the wire insulation 30 is removed from the terminations 19*a* through 19*d*, and the terminations are soldered to the shields 18*a* through 18*d*, respectively. The finished transformer is mounted on the printed circuit board by soldering the shields 18*a* through 18*d* to the connection pads 14*a* through 14*d* of the board, via the surface contacts 17*a* through 17*d* and solder contacts 15*a* through 15*d*, respectively.

Other embodiments are within the scope of the following claims. For example, the same techniques could be used for any kind of inductive device, including inductors and chokes, with any number of windings and any number of turns in each winding. The windings may be formed using material other than wound wire, such as metallic foil or metallic film. Other shield patterns may be used. The core could be made of pressed iron powder and may have a different geometry, including toroidal and bar type. Paraxylylene could be replaced by other insulating materials. The wire winding terminations could be attached to the shields by thermal compression bonding. Tin may be deposited by immersion plating. The inductive device could be attached to the board contacts via a conductive adhesive.

What is claimed is:

1. An inductive device comprising a magnetic core comprising a loop of magnetic material defining a flux path surrounding an aperture, the aperture extending completely between external surfaces of the core, first and second electrically conductive elements formed on selected portions of the external surfaces of the core along the loop;

a first conductive winding having one or more turns of a conductor wound over the external surfaces on which the conductive elements are formed and primarily located between the conductive elements, the winding enclosing the flux path, each of the turns being threaded through the aperture, and first and second terminations of the first winding mechanically attached and electrically connected to the first and second conductive elements.

2. The inductive device of claim 1 wherein the loop comprises an inside perimeter and an outside perimeter, and wherein at least one of the inside and outside perimeters is non-circular.

3. The inductive device of claim 2 wherein the inside and outside perimeters are non-circular.

4. The inductive device of claim 3 wherein the inside perimeter comprises a square and the outside perimeter comprises an octagon.

5. The inductive device of claim 4 wherein the core comprises flat top and bottom surfaces.

6. The inductive device of claim 4 wherein at least one of the conductive elements forms a shield for controlling leakage flux emanation from the core, and the shield covers substantially all of the corners and edges of the outer perimeter of the core.

7. The device of claim 1, 2, 3, 4, or 5 further comprising a second conductive winding having turns enclosing the flux path, the second winding comprising two terminations, two additional electrically isolated conductive elements formed on selected portions of the external surface of the core, mechanically attached and electrically connected to the two terminations of the second winding.

8. The inductive device of claim 7 wherein at least one of the conductive elements forms a shield for controlling leakage flux emanation from the core.

9. The inductive device of claim 8 wherein each of the conductive elements forms a shield for controlling leakage flux emanation from the core.

10. The inductive device of claim 8 wherein the first and second conductive windings are separated by a distance along the flux path and the conductive elements are located between the windings.

11. The inductive device of claim 8 wherein edges formed in the outer circumference of the loop are covered by the shield.

12. The inductive device of claim 1 wherein at least one of said first and second conductive elements is arranged to form a shield for controlling leakage flux emanating from the core.

13. The inductive device of claim 12 wherein the shield covers portions of the outer circumference of the core.

14. The inductive device of claim 12 wherein the shield covers substantially all of the outer circumference of the core.

15. The inductive device of claim 12 wherein the shield covers substantially all of the outer circumference and the bottom of the core.

16. The inductive device of claim 12 wherein the shield covers substantially all of the outer circumference, the top, and the bottom of the core.

17. The inductive device of claim 12, 13, 14, 15, or 16 wherein the magnetic core comprises an electrical insulation layer.

18. The inductive device of claim 17 wherein the insulation layer comprises a para-xylylene polymer.

19. The inductive device of claim 17 further comprising:

a second conductive winding having turns enclosing the flux path, the winding comprising two terminations, two additional electrically isolated conductive elements formed on selected portions of the external surface of the magnetic core and arranged to form shields for controlling leakage flux emanating from the core, wherein the two additional conductive elements are mechanically attached and electrically connected to the two terminations of the second winding.

20. The inductive device of claim 17 wherein the loop comprises an inside perimeter and an outside perimeter, and wherein at least one of the inside or outside perimeters is non-circular.

21. The inductive device of claim 20 wherein the inside and outside perimeters are non-circular.

22. The inductive device of claim 21 wherein the inside perimeter comprises a square and the outside perimeter comprises an octagon.

23. The inductive device of claim 16 wherein the core comprises flat top and bottom surfaces.

24. The inductive device of claim 23 wherein the shields cover all of the corners of the octagon and portions of the corners formed by the junction of the outside perimeter along the top and bottom of the core.

25. The device of claim 24 further comprising a second conductive winding having turns enclosing the flux path , the winding comprising two terminations, two additional electrically isolated conductive elements formed on selected portions of the external surface of the magnetic core and arranged to form shields for controlling leakage flux emanating from the core, wherein the two additional conductive elements are mechanically attached and electrically connected to the two terminations of the second winding.

26. An assembly comprising the device of claim 25 and further comprising a circuit board bearing connection pads, and the conductive elements each being mechanically attached and electrically connected to a respective connection pad.

27. The inductive device of claim 26 wherein the terminations of the windings and the connection pads are mechanically attached to the conductive elements on the bottom of the core.

28. The device of claim 12, 13, 14, 15, or 16 further comprising a second conductive winding having turns enclosing the flux path, the winding comprising two terminations, two additional electrically isolated conductive elements formed on selected portions of the external surface of the magnetic core and arranged to form shields for controlling leakage flux emanating from the core, wherein the two additional conductive elements are mechanically attached and electrically connected to the two terminations of the second winding.

29. An assembly comprising the inductive device of claim 1, 2, 3, 4, 5, 12, 13, 14, 15, or 16 and further comprising a circuit board bearing connection pads, and the conductive elements each being mechanically attached and electrically connected to a respective connection pad.

30. The assembly of claim 29 wherein the terminations of the windings and the connection pads are mechanically attached to the conductive elements at the bottom of the core.

31. The inductive device of claim 12, 13, 14, 15, or 16 wherein the loop comprises an inside perimeter and an outside perimeter, and wherein at feast one of the inside or outside perimeters is non-circular.

32. The inductive device of claim 31 wherein the inside and outside perimeters are non-circular.

33. The inductive device of claim 32 wherein the inside perimeter comprises a square and the outside perimeter comprises an octagon.

34. The inductive device of claim 33 wherein the magnetic core comprises flat top and bottom surfaces.

35. The inductive device of claim 31 wherein the loop is annular.

36. The inductive device of claim 31 wherein the loop is a toroid.

37. The inductive device of claim 1 or 12 wherein the winding comprises metallic wire.

38. The inductive device of claim 1 or 12 wherein the winding further comprises an insulation layer.

39. The inductive device of claim 1 or 12 wherein the winding comprises metallic foil.

40. The inductive device of claim 1 or 12 wherein the winding comprises metallic film lines.

41. The inductive device of claim 1 or 12 wherein the conductive element comprises a silver-filled epoxy.

42. The inductive device of claim 1 or 12 wherein the conductive element comprises copper.

43. The inductive device of claim 1 or 12 wherein the conductive element comprises tin.

44. The inductive device of claim 1 or 12 wherein the conductive element comprises layers.

45. The inductive device of claim 1 or 12 wherein the magnetic core comprises ferrite material.

46. The inductive device of claim 1 or 12 wherein the magnetic core comprises iron powder material.

47. The inductive device of claim 1 or 12 wherein the core comprises flat top and bottom surfaces.

48. The inductive device of claim 1 wherein the loop comprises an outside perimeter, at least one of the conductive elements forms a shield for controlling leakage flux emanation from the core, and the shield covers substantially all of the corners and edges of the outer perimeter of the core.

* * * * *

UNITED STATES PATENT AND TRADEMARK OFFICE

CERTIFICATE OF CORRECTION

PATENT NO. : 6,246,311 B1 
DATED : June 12, 2001
INVENTOR(S) : Fred M. Finnemore, Steven N. Montiminy and Patrizio Vinciarelli It is certified that error appears in the above-identified patent and that said Letters Patent is hereby corrected as shown below:

Column 3,
Line 45, change “0.211”” to -- 0.2” --.

Column 6,
Line 24, change “feast” to -- least --.

Signed and Sealed this

Second Day of September, 2003

JAMES E. ROGAN
*Director of the United States Patent and Trademark Office*